US010709252B2

(12) United States Patent
Volk et al.

(10) Patent No.: US 10,709,252 B2
(45) Date of Patent: Jul. 14, 2020

(54) AIR THRONE

(71) Applicant: Air Throne, LLC, Redding, CA (US)

(72) Inventors: Joseph Samuel Volk, Redding, CA (US); Eric Douglas Pierson, Redding, CA (US); Robert Matthew Strand, Redding, CA (US)

(73) Assignee: Air Throne, LLC, Redding, CA (US)

( * ) Notice: Subject to any disclaimer, the term of this patent is extended or adjusted under 35 U.S.C. 154(b) by 0 days.

(21) Appl. No.: 16/248,542

(22) Filed: Jan. 15, 2019

(65) Prior Publication Data

US 2019/0216225 A1 Jul. 18, 2019

Related U.S. Application Data

(60) Provisional application No. 62/618,010, filed on Jan. 16, 2018.

(51) Int. Cl.

| | |
|---|---|
| ***A47C 7/00*** | (2006.01) |
| ***A47C 9/08*** | (2006.01) |
| ***A47C 3/30*** | (2006.01) |
| ***A47C 7/74*** | (2006.01) |
| ***A47C 7/18*** | (2006.01) |

(52) U.S. Cl.

CPC ..... *A47C 9/08* (2013.01); *A47C 3/30* (2013.01); *A47C 7/004* (2013.01); *A47C 7/18* (2013.01); *A47C 7/744* (2013.01)

(58) Field of Classification Search

CPC .... A47C 1/06; A47C 3/20; A47C 3/30; A47C 7/004; A47C 7/18; A47C 7/72; A47C 7/74; A47C 7/744; A47C 9/02; A47C 9/08

See application file for complete search history.

(56) References Cited

U.S. PATENT DOCUMENTS 4,671,567 A * 6/1987 Frobose ..... A47C 7/62 297/452.1
5,377,943 A * 1/1995 Perl ..... A47C 7/004 248/188.7

(Continued)

FOREIGN PATENT DOCUMENTS

DE 2705458 A1 * 8/1978 ..... A47C 3/30
FR 2558147 A1 * 7/1985 ..... B29C 66/45

(Continued)

OTHER PUBLICATIONS

Machine Translation of DE2705458; https://worldwide.espacenet.com/patent/search/family/050980082/publication/DE2705458A1?q=DE2705458 (Year: 2020).*

*Primary Examiner* — Ryan D Kwiecinski
(74) *Attorney, Agent, or Firm* — Goodhue, Coleman & Owens, P.C.

(57) ABSTRACT

A drum throne is provided which allows air to flow through it in order to keep a drummer dry and free of sweat buildup during drumming sessions. The drum throne may include a seat base, a seat foam on a upper portion of the seat base, a top portion of a seat cover for covering the seat foam, an air plenum located between the seat base and the seat foam, airflow channels extending from the air plenum to the top portion of the seat cover, and a mounting plate below the seat base and coupled to an intake cover; or a blower below a bottom portion of the seat base, the blower capable of pushing air into the air plenum, up through the airflow channels and seat cover to a user.

14 Claims, 10 Drawing Sheets

(56) References Cited

U.S. PATENT DOCUMENTS

| | | | | | |
|---|---|---|---|---|---|
| 6,003,944 | A * | 12/1999 | Glockl | A47C 3/18 | 297/337 |
| 6,672,660 | B2 * | 1/2004 | Hoshino | A47C 7/029 | 297/195.1 |
| D598,209 | S * | 8/2009 | Lippert | D6/367 | |
| 8,066,624 | B1 * | 11/2011 | Stroup | A47C 9/002 | 297/338 |
| 8,696,059 | B2 * | 4/2014 | Carmichael, IV | A47C 7/02 | 297/195.11 |
| 9,173,500 | B2 * | 11/2015 | Squires | A47C 7/744 | |
| 10,206,509 | B1 * | 2/2019 | Liao | A47C 9/08 | |
| 10,266,082 | B2 * | 4/2019 | Noguchi | A47C 7/74 | |
| 2007/0012848 | A1 * | 1/2007 | Liao | A47C 3/24 | 248/439 |
| 2010/0295350 | A1 * | 11/2010 | Barman | A47C 3/36 | 297/313 |
| 2013/0009441 | A1 * | 1/2013 | Carmichael, IV | A47C 7/02 | 297/451.2 |
| 2013/0328359 | A1 * | 12/2013 | Antonov | A47C 7/742 | 297/180.14 |
| 2016/0316918 | A1 * | 11/2016 | Rhoden | A47C 7/029 | |
| 2017/0066121 | A1 * | 3/2017 | Huang | A47C 7/004 | |
| 2019/0232835 | A1 * | 8/2019 | Murakami | B60H 1/00285 | |

FOREIGN PATENT DOCUMENTS

| | | | | |
|---|---|---|---|---|
| WO | WO-2015045874 | A1 * | 4/2015 | A47C 7/35 |
| WO | WO-2016021225 | A1 * | 2/2016 | A47C 7/74 |

* cited by examiner

AIR THRONE

RELATED APPLICATIONS

This application claims priority to U.S. Provisional Patent Application No. 62/618,010, filed Jan. 16, 2018, hereby incorporated by reference in its entirety.

FIELD OF THE INVENTION

The present invention relates to musical instruments. Particularly, the present invention relates to musical instrument accessories. More particularly, but not exclusively, the present invention relates to seating for musical instruments.

BACKGROUND

A drum "throne" is a three or four-legged padded seat or stool the drummer sits on while playing. Thrones may be shaped like round cushions or in a saddle design. Throne heights may be adjusted to accommodate the drummer.

The drummer performs while seated on a drum throne to free up both arms and legs for the performance of instruments such as drums and percussive instruments positioned around the drummer. To facilitate easy access to drum and percussive instruments set up around the drummer, a typical drum throne includes a padded seat cushion, which is usually constructed from polyurethane foam covered in vinyl. A tri-legged stand supports the seat cushion and provides a stable base required to position the drummer for convenient reach of the drum and percussive instruments of the drum kit. The tri-legged stand can also include a height adjustment feature, so the drummer can set the throne to a desired height.

Many times, during long drumming sessions sweat can build up and cause very uncomfortable conditions for the drummer. Therefore, what is needed is a way to keep a drummer cool during his (her) drumming performance and/or practice.

SUMMARY

Therefore, it is a primary object, feature, or advantage of the present invention to improve over the state of the art.

It is a further object, feature, or advantage to provide a seat throne which keeps a musician dry and free of sweat buildup during a drumming session.

It is a still further object, feature, or advantage to provide a seat throne which allows the musician to adjust air flow according to their needs.

It is another object, feature, or advantage to provide a seat throne which is height adjustable.

According to one aspect, a drum throne may include a seat base; a seat cover further comprising a seat foam; an air plenum located between the seat base and the seat foam; airflow channels extending from the air plenum to the seat cover; a blower exhaust coupled to the seat base capable of pushing air through the seat base and into the air plenum and up through the airflow channels and seat cover; a blower located below the blower exhaust and the seat base capable of pushing air through the blower exhaust; or a blower intake capable of bringing air into the blower. The drum throne may be comprised of a mounting plate coupled to the seat base; an intake cover surrounding the blower and coupled to a mounting plate; a input jack located on the intake cover and operatively coupled to the blower; a power switch operatively coupled to the blower and located on the intake cover; a lift handle coupled to the mounting plate for raising and lowering the seat base; and a spring retention cylinder coupled to the mounting plate and an upper leg brace and a lower leg brace.

According to another aspect, a drum throne may include a mounting plate; a spring retention cylinder coupled to the mounting plate; at least three lower leg braces coupled to a lower portion of the spring retention cylinder; at least three upper leg braces, wherein each upper leg brace is coupled to an upper portion of the spring retention cylinder, at least one of the lower leg braces and a seat foot; a lift handle couple to the mounting plate a mounting bracket coupled to the mounting plate and the spring retention cylinder; a blower coupled to the mounting plate; a seat base coupled to the mounting plate; an air plenum coupled to the seat base; or a seat foam covering the air plenum having airflow channels extending from the air plenum to a seat cover, and the drum throne may include a dial operatively connected to the blower for adjusting speed of the blower; a power switch located on the intake cover and operatively connected to the blower; or a leg handle to lock the upper leg braces to the spring retention cylinder.

According to yet another aspect, a drum throne may include a seat base; a seat foam on a upper portion of the seat base; a top portion of a seat cover for covering the seat foam, (d) an air plenum located between the seat base and the seat form; airflow channels extending from the air plenum to the top portion of the seat cover; a mounting plate below the seat base and coupled to an intake cover; or a blower below a bottom portion of the seat base, the blower capable of pushing air into the air plenum, up through the airflow channels and seat cover to a user. The drum throne may include a blower exhaust located adjacent to the seat base; an air intake capable of bringing air into the blower; a power switch electrically coupled to the blower and located on the intake cover; an input jack located on the intake cover and electrically coupled to the blower; a mounting plate coupled to the intake cover and the seat base; a blower coupled to the intake cover and below a bottom portion of the seat base, the blower capable of pushing air into the air plenum, up through the airflow channels and seat cover to a user; a blower exhaust coupled to the seat base; at least three lower leg braces coupled to a lower portion of the spring retention cylinder; or at least three upper leg braces, wherein each upper leg brace is coupled to an upper portion of the spring retention cylinder, at least one of the lower leg braces and a seat foot.

One or more of these and/or other objects, features, or advantages of the present invention will become apparent from the specification and claims that follow. No single aspect need provide each and every object, feature, or advantage. Different aspects may have different objects, features, or advantages. Therefore, the present invention is not to be limited to or by an objects, features, or advantages stated herein.

DETAILED DESCRIPTION

Figure 1:
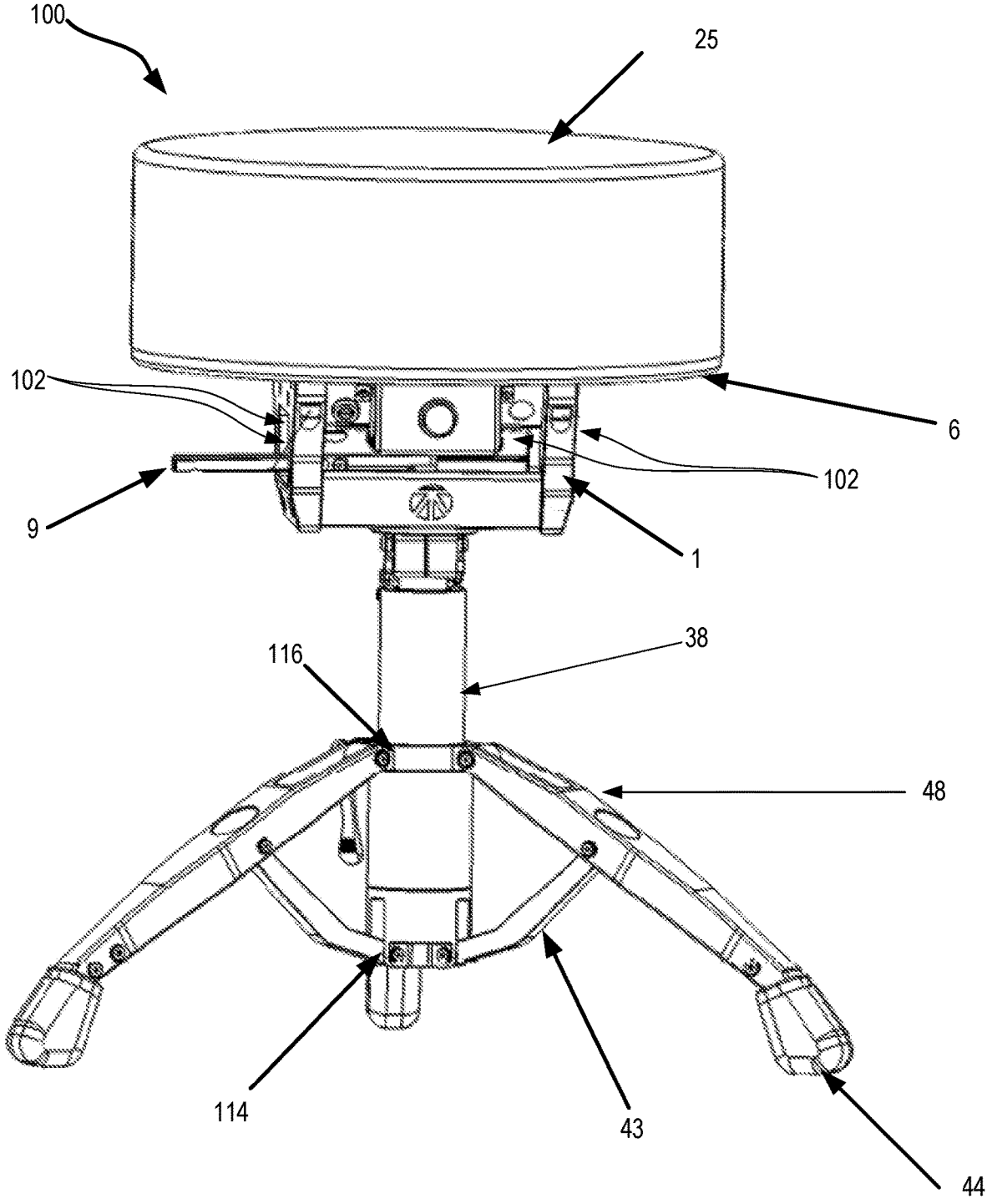
FIG. 1 is a front profile view of a cooling drummer's throne with airflow in accordance with an aspect of the present invention.

The following discussion is presented to enable a person skilled in the art to make and use the present teachings. Various modifications to the illustrated aspects will be clear to those skilled in the art, and the generic principles herein may be applied to other aspects and applications without departing from the present teachings. Thus, the present teachings are not intended to be limited to aspects shown but are to be accorded the widest scope consistent with the principles and features disclosed herein. The following detailed description is to be read with reference to the figures, in which like elements in different figures have like reference numerals. The figures, which are not necessarily to scale, depict selected aspects and are not intended to limit the scope of the present teachings. Skilled artisans will recognize the examples provided herein have many useful alternatives and fall within the scope of the present teachings. While aspects of the present invention are discussed in terms of drumming thrones, it is fully contemplated aspects of the present invention could be used in most any musical seat without departing from the spirit of the invention.

Figure 2:
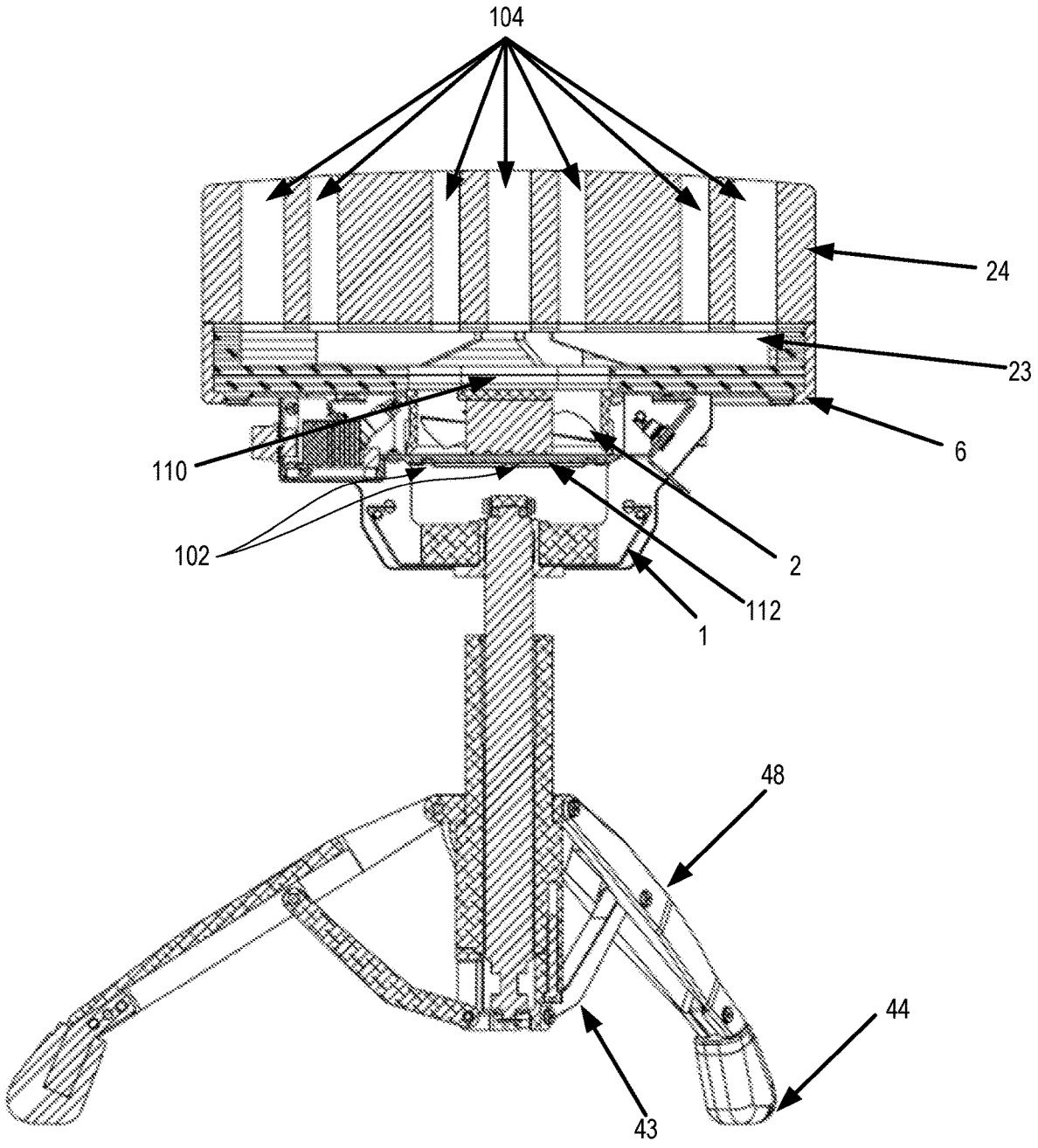
FIG. 2 is a side profile view of a cooling drummer's throne in accordance with an aspect of the present invention.
Figure 3:
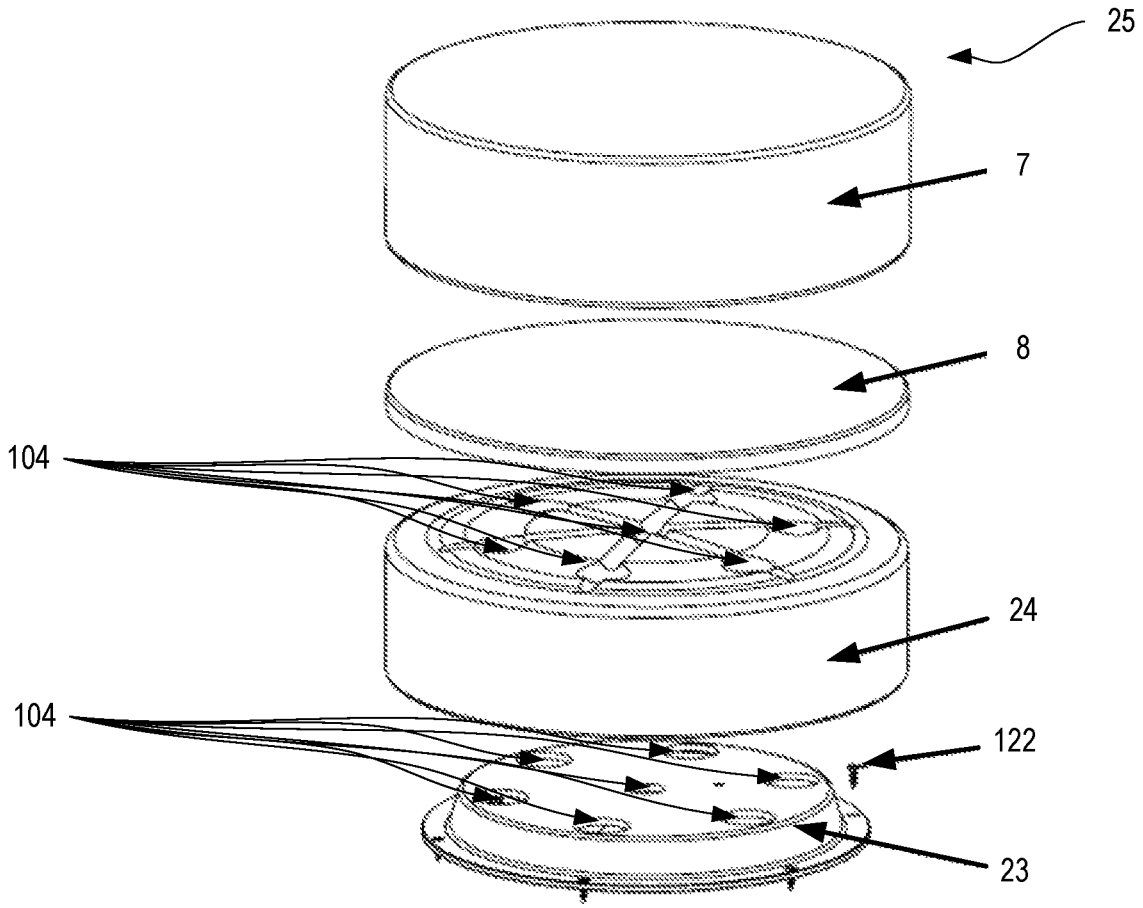
FIG. 3 is an exploded view of the seat cover in accordance with an aspect of the present invention.

With reference to FIGS. 1, 2 and 3, a drumming throne 100 having air 102 flowing through it to keep a drummer dry and free of sweat buildup during drumming sessions is shown. Drumming throne 100 provides ventilation to the seat base 6 during drumming sessions. The seat base 6 is the platform for mounting all hardware above and below the seat base 6.

Many times, during long drumming sessions sweat can build up and cause very uncomfortable conditions for the drummer. By moving air 102 at a constant velocity through the seat base 6 it mitigates the buildup of sweat and allows the drummer to remain dry and much more comfortable throughout the drumming session. Airflow 102 can be seen being brought in by blower 2 through blower intake 110. Blower 2 then moves the airflow 102 through blower exhaust 112 and into air plenum 23. From here airflow 102 moves into airflow channels 104 within seat foam 24 traversing upward towards seat cover 25 and thus to the gluteus maximus/back/legs of a user/drummer. This action supplies cooler air and/or a flow of air which can cool and/or wick away any sweat buildup on a drummer. The wicking away of the sweat helps keep the drummer cooler, less sticky and overall more comfortable during their performance sessions.

In one aspect lower leg brace 43 is coupled to upper leg brace 48 near the middle of upper leg brace 48. In other aspects drumming throne 100 has a lower leg brace 43 coupled to upper leg brace 48 near seat foot 44, thus creating a right triangle to provide proper weight distribution and stability for a drummer as shown by FIG. 6. Lower leg brace 43 couples to a lower portion of spring-retention cylinder 114 and keeps upper leg brace 48 from extending outward indefinitely. The upper leg brace 48 is coupled to the upper portion of spring-retention cylinder 116 near the spring retention cylinder 38. For the purposes of the discussion of the current aspect of the present invention, coupling could occur in most any fashion to those well versed in the state of the art. Coupling could occur through a nut-and-bolt assembly, rivets, post and cotter-pin assemblies, dowels, etc. without departing from the spirit of the invention.

Drumming throne 100 may have an adjustable seat base height which may be activated by a gas-charged spring 108 (FIG. 9) activated by lift handle 9. A gas spring is a type of spring, unlike a typical mechanical spring relying on elastic deformation, uses compressed gas contained within an enclosed cylinder sealed by a sliding piston to pneumatically store potential energy and withstand external force applied parallel to the direction of the piston shaft. Common applications include office chairs. The drummer would sit on drumming throne 100 and then pull up on lift handle 9 to lower drumming throne 100. The drummer could also remove their weight off drumming throne 100 and lift handle 9 once again to cause drumming throne 100 to raise.

FIG. 3 illustrates an exploded view of seat cover 25. Seat cover 25 may have a top cover 8 for the drummer to sit on. Top cover 8 is placed over seat foam 24. Top cover 8 is preferably made of a material which allows air to pass through from airflow channels 104 to the drummer. Such material could be materials such as bamboo, cotton, Gore-Tex, nylon, polyester, polypropylene, spandex and/or TENCEL. In other aspects air channels 104 may extend from the seat foam 24 through top cover 8. As shown seat cover 25 may have a middle cover 7 surrounding the seat foam. Middle cover 7 is preferably made of a material which allows air to pass through from airflow channels 104 to the drummer. Such material could be materials such as bamboo, cotton, Gore-Tex, nylon, polyester, polypropylene, spandex and/or TENCEL.

Airflow 102 moves into from the air plenum 23 into the airflow channels 104 within seat foam 24 traversing upward towards top cover 8 and thus to the gluteus maximus/back/legs of a user/drummer. Seat foam 24 may have a one or more airflow channels 104 allowing airflow to the top cover 8. The seat foam 24 contains airflow channels 104 directing the airflow 102 to specific locations throughout the surface of the seat base 6. The air plenum receives airflow 102 from blower 2. The air plenum 23 distributes the airflow 102 to the airflow channels 104 in the seat foam 24. Airflow channels 104 can be formed into seat foam 24 or airflow channels 104 could be separate from seat foam 24 and couple to airflow plenum 23. However, airflow channels 104 could be formed as part of air plenum 23. Seat cover 25 is secured to the seat base 6 by fasteners 122.

Figure 5:
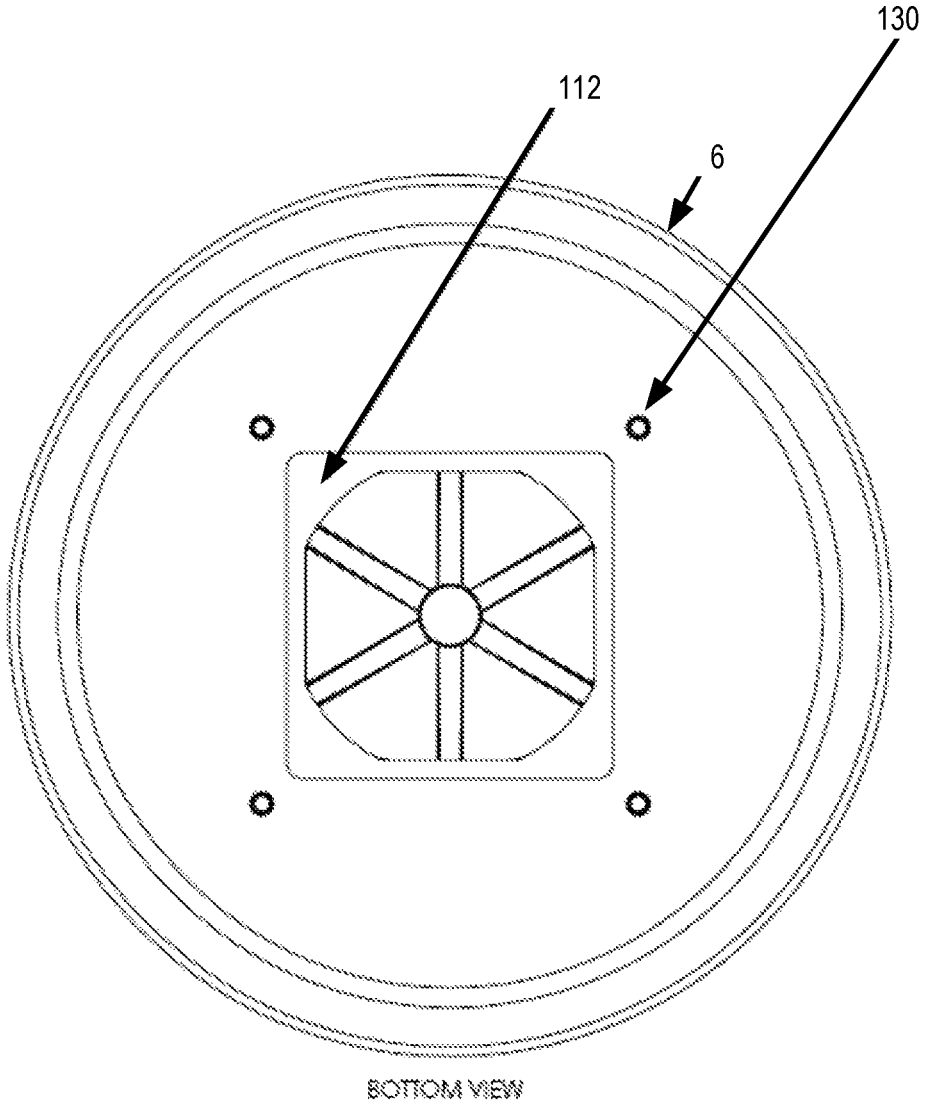
FIG. 5 is a bottom profile view of a seat base in accordance with an aspect of the present invention.

FIG. 5 illustrates a bottom view of seat base 6. As shown seat base 6 has exhaust 112 which receives air flow 102 from blower 2 and allows air to flow into air plenum 23. Exhaust 112 may be adjacent to air plenum 23. Seat base 6 is coupled to mounting plate 1 with fasteners 130. Seat base 6 could be made of most any type of material such as wood, metal and/or plastic so long as seat base 6 is able to withstand the weight of a human being (e.g., able to support up to 500 lbs.). Seat base 6 is coupled to seat cover 25 by fasteners 122. In some aspects seat foam 24 may be directly coupled to seat base 6.

Figure 4:
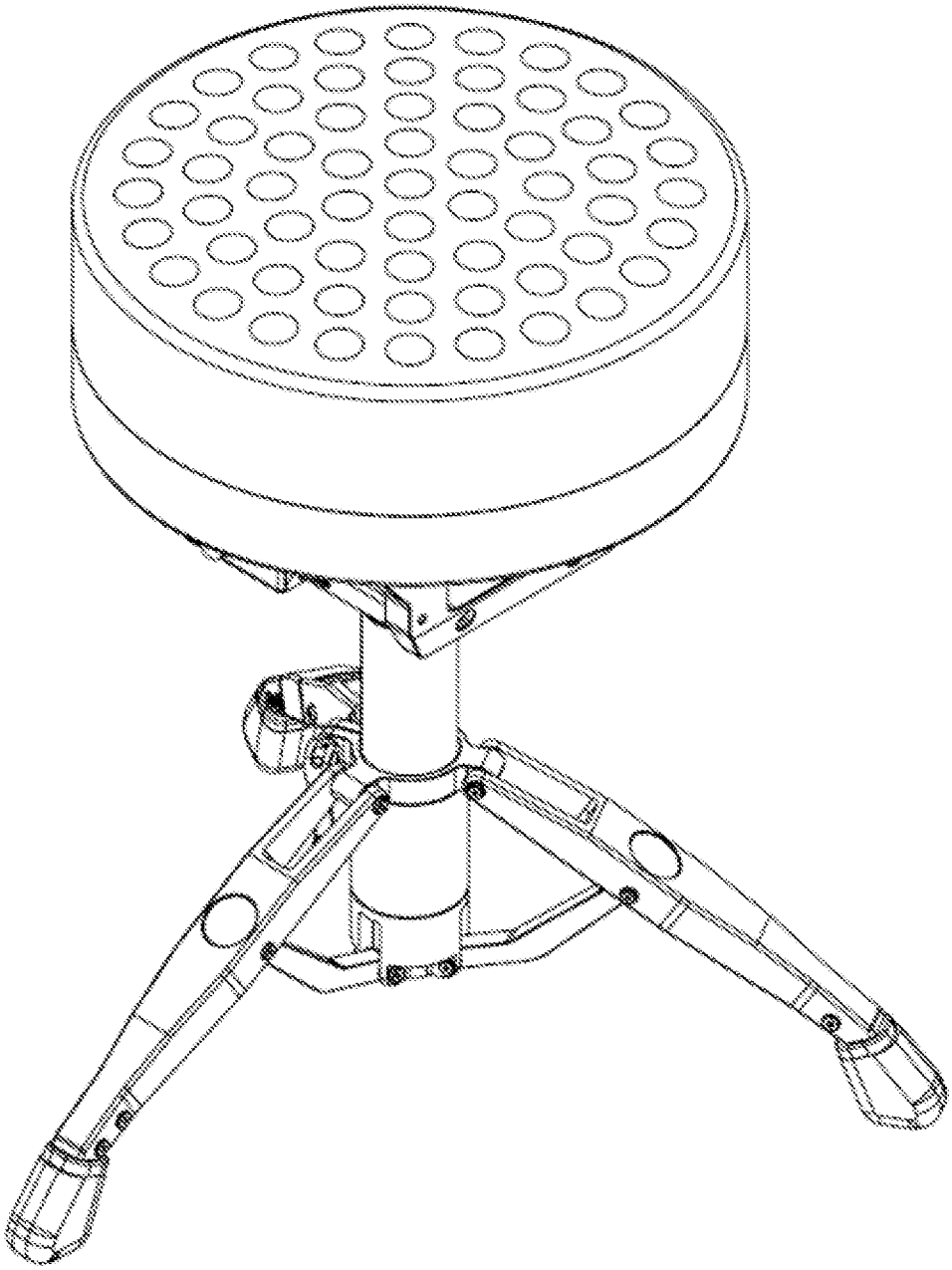
FIG. 4 is a side perspective view of a cooling drummers throne in accordance with an aspect of the present invention.
Figure 6A:
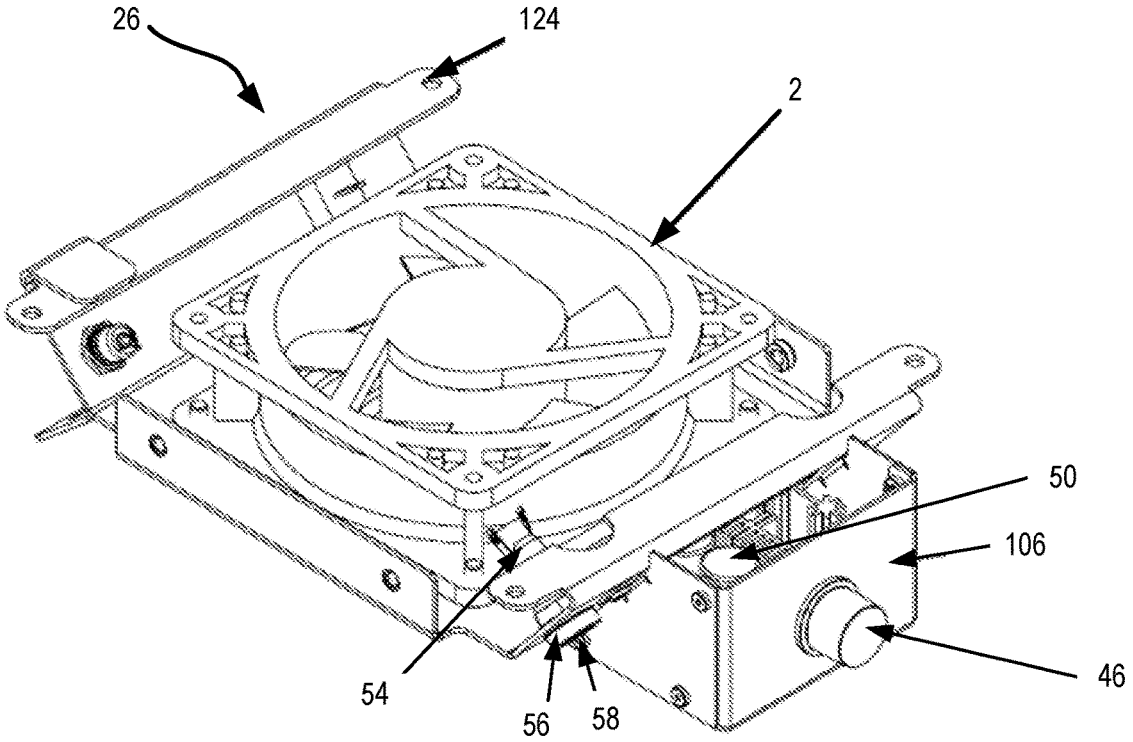
FIG. 6A is a profile view of an intake cover in accordance with an aspect of the present invention.
Figure 6B:
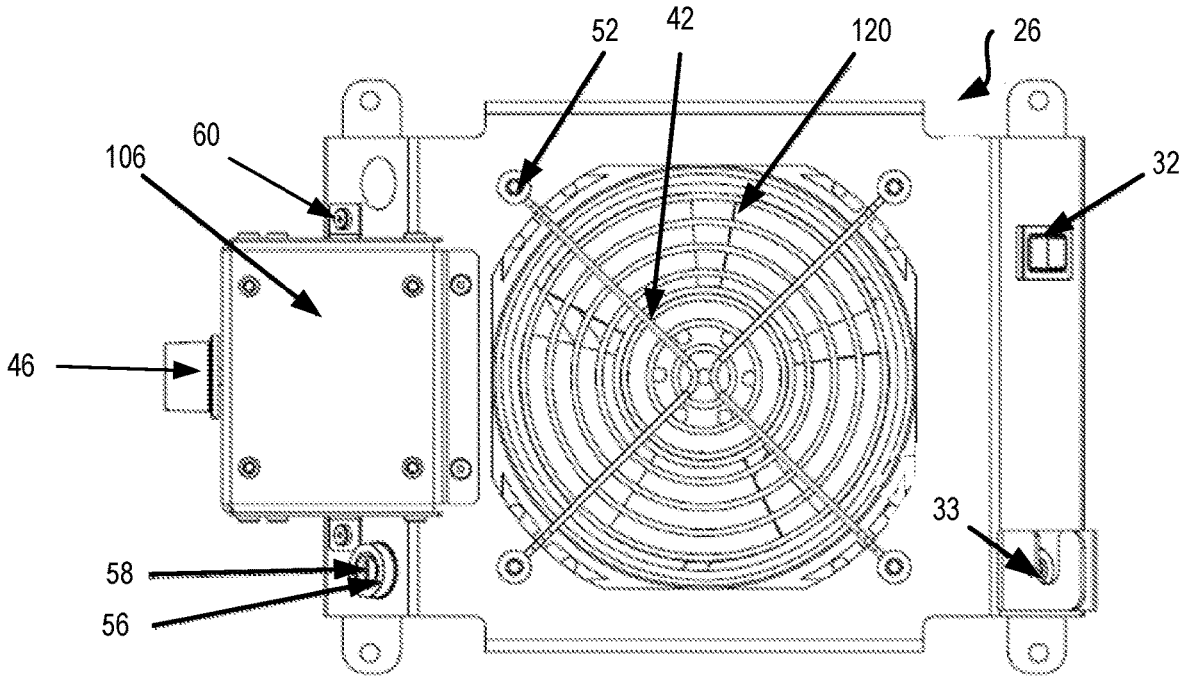
FIG. 6B is a bottom view of an intake cover in accordance with an aspect of the present invention.

FIGS. 6A and 6B illustrate intake cover 26. Intake cover 26 covers and protects blower 2 and the electronics operatively connected to the blower 2 or the power box 106. Blower 2 is located below seat base 6. Blower 2 moves air from intake 110 and exhausts up into the air plenum 23 through exhaust 112 and through the seat foam 24. Intake cover 26 is shown with slots 120 to allow airflow 102 to pass through slots 120 to intake 110. Intake 110 may be located on the bottom of intake cover 26 as shown by FIG. 4B allowing airflow 102 to come from any direction. In another aspect intake 110 may be located on the side of the drummer's throne 100 as shown in FIG. 7. Blower intake 110 is adjacent to slots 120 in intake cover 26. Intake cover 26 is coupled to mounting plate 1 by fasteners 124. Blower 2 may be operatively connected to speed controller 50, wherein speed controller 50 controls the rate Blower 2 is intaking air. If the drummer wants to lower the blower speed, the drummer may turn the dial one direction, the speed controller than reduces the speed of the blower 2. Intake over 26 may have support bars 42 to support intake 110. Support bars 42 may be coupled to intake cover 26 by fasteners 52. Intake cover may be coupled to mounting plate 1 by fasteners 124.

In some aspects drumming throne 100 has a power switch 32. Power switch 32 is mounted on intake cover 26 and as described below controls the flow of power from IEC inlet filter 33 to blower 2. Power switch 32 is shown as a rocker power switch 32 with an on position and an off position. If the drummer does not want to use the blower the drummer can turn the power off. If the drummer wants to use the blower the drummer can turn the power on. The power switch 32 may be operatively connected to a speed controller 50 which is configured to increase or reduce the blower speed. In an alternative aspect power switch 32 is operatively connected to blower 2. In other aspects, power switch 32 is a three-position switch allowing for the selection of high and low blower speeds as well as an off position. Thus, when a user is performing a drumming session and begin getting warm, the drummer could flip power switch 32 into a low blower speed. If the low blower speed was not enough, then the drummer could move power switch 32 into a high blower speed to attempt to cool down. In other aspects of the present invention the power switch 32 may be configured as a turn dial or a button.

In some aspects, the drumming throne 100 may include a power box 106. Power box 106 is adjacent and coupled to intake cover 26 by fasteners 60. In other aspects power box 106 may be located with the intake cover 26 or mounting plate 1. Power box 106 may have a dial to adjust the blower speed. Thus, when a user is performing a drumming session and begin getting warm, the drummer could turn dial 46 in one direction for a lower blower speed. If the low blower speed was not enough, then the drummer could turn dial 46 further in the same direction for a high blower speed to attempt to cool down. The drummer could turn the dial 46 in the opposite direction to lower the blower speed. Dial 46 may be operatively connected to speed controller 50. If the drummer wants to lower the blower speed, the drummer may turn the dial 46 one direction, the speed controller 50 than reduces the speed of the blower 2.

In one aspect the drumming throne 100, may have a DC input jack 33 which can accept a power cord to supply power to drumming throne. Jack 33 may be adjacent to power switch 32. Jack 33 can include a filter as well as a fuse 54 and/or switch. Fuse 54 may have a fuse holder 56 and a fuse holder cap 58. In other aspects, the drumming throne 100 may have an IEC inlet filter/plug which may accept a power cord to supply power to the drumming throne 100 (i.e., 60 cycle 120 volts provided by most American outlets). Within power box 106 could be a transformer which would down convert the 60 cycle 120 volts into a usable voltage for the blower 2 (i.e., the transformer would down convert the voltage to between 10-20 volts). IEC inlet filter/plug 33 are ideal for industrial and commercial electronics requiring EMI/RFI protection, including computers, communications equipment, LCD TVs, toys and sports and fitness equipment.

Figure 7A:
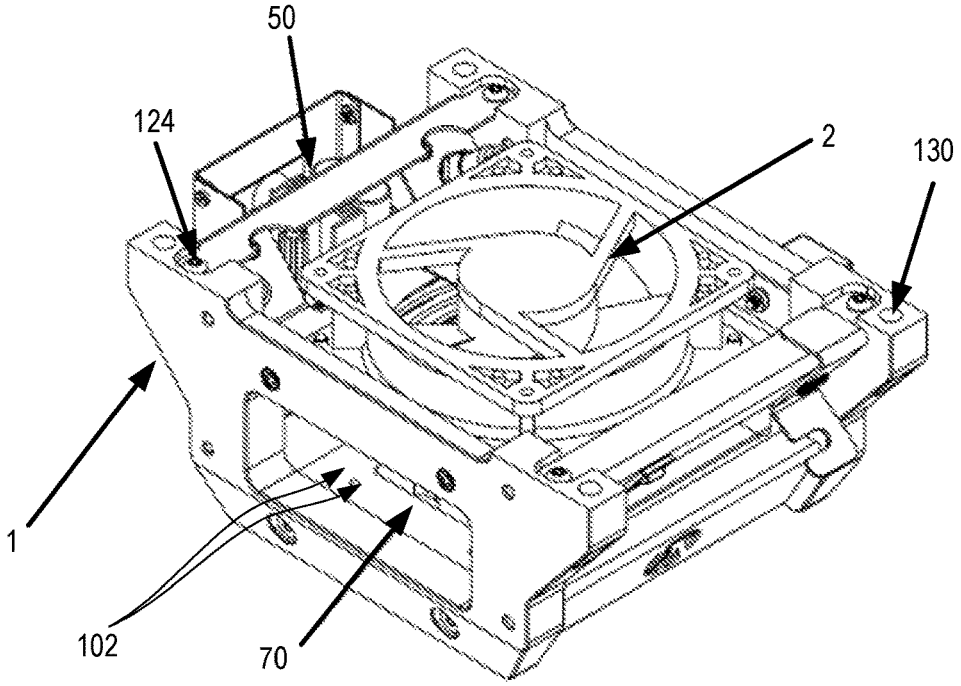
FIG. 7A is a profile view of a mounting plate in accordance with an aspect of the present invention.
Figure 7B:
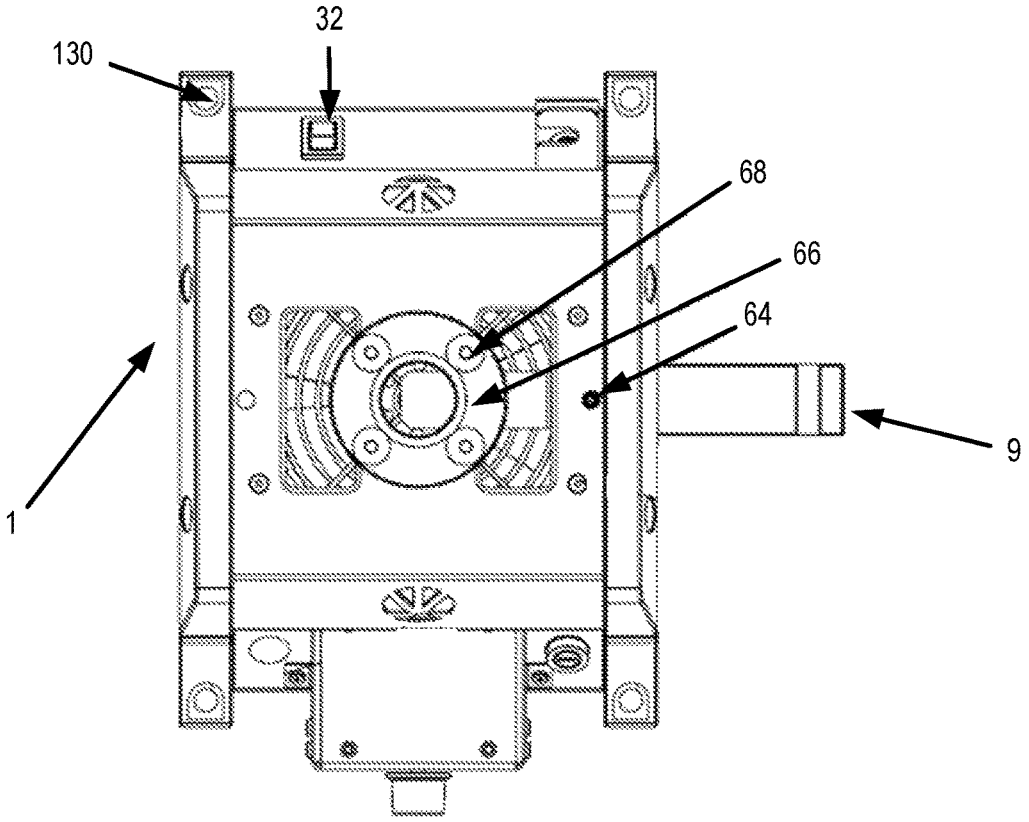
FIG. 7B is a bottom view of a seat base of a mounting plate in accordance with an aspect of the present invention.

FIGS. 7A and 7B illustrate one aspect of mounting plate 1. Mounting plate 1 supports the blower 2, air plenum 23, seat cover 25, intake cover 26, seat base 6 and lift handle 9. Mounting plate 1 is coupled to blower 2 and intake cover 26 with fasteners 124. Mounting plate 1 is coupled to seat base 6 by fasteners 130. Mounting plate 1 is coupled to spring retention cylinder 38 and mounting bracket 66 using fasteners 68. Mounting plate 1 may have openings 70 on one or more sides of mounting plate 1 allowing airflow 102 to flow into intake 110 to blower 2 from one or more directions.

Mounting plate 1 is coupled to lift handle 9 with fasteners 64, which actuates gas charged lift spring 108. Gas charged lift spring rests within spring retention cylinder 38, as shown by FIG. 6. Mounting plate 1 may be attached to power box 106. The controller assembly may include a speed controller for controlling the speed of blower 2, and a turn dial operatively connected to the speed controller for controlling the speed controller. If the drummer wants to lower the blower speed, the drummer may turn the dial one direction, the speed controller than reduces the speed of the blower 2. Mounting plate 1 may include a DC input jack to supply power to the drummer throne 100.

Figure 8:
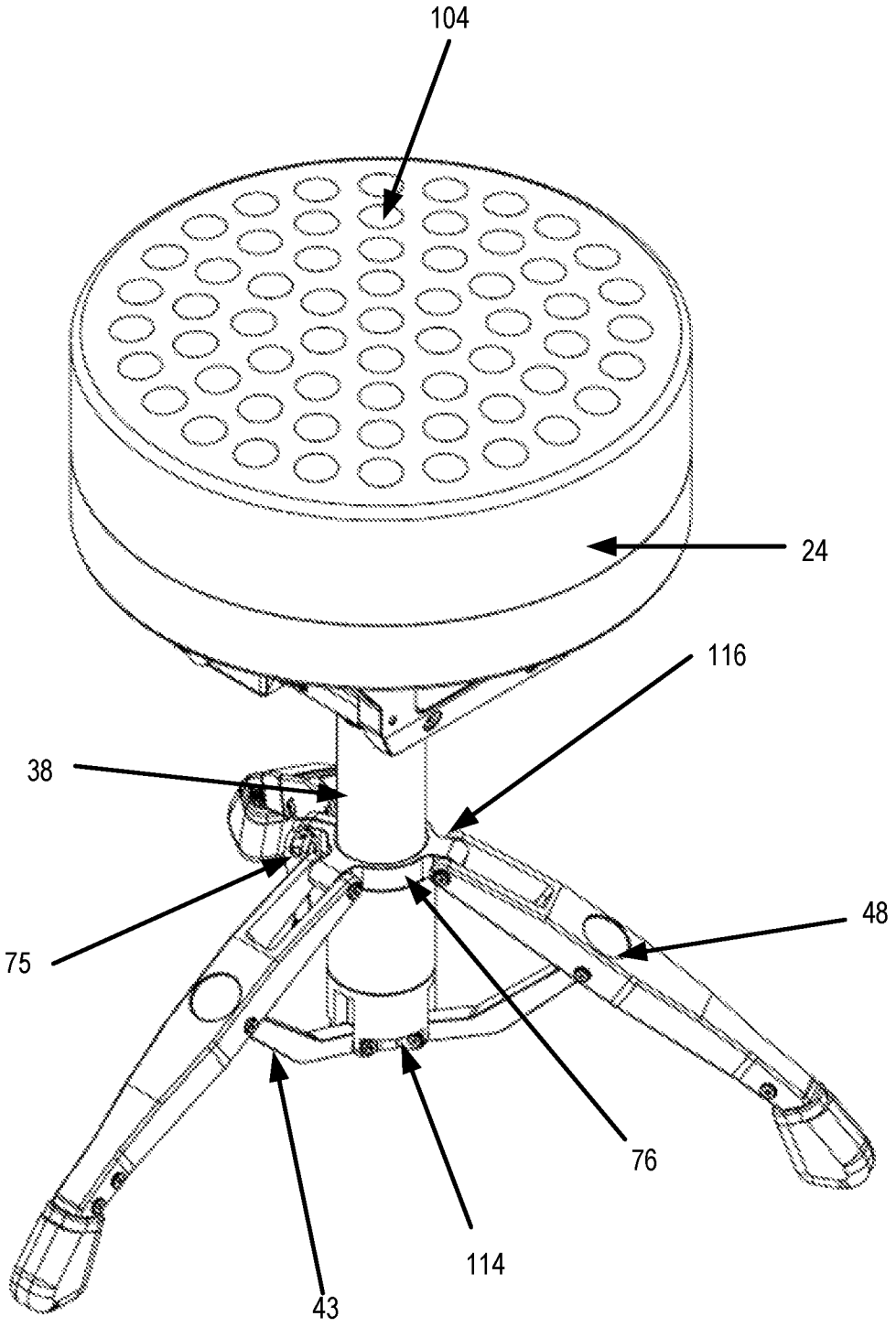
FIG. 8 is a side profile view of a cooling drummer's throne in accordance with an aspect of the present invention.

FIG. 8 illustrates a side perspective of one aspect of the drumming throne 100. The drumming throne 100 may have a leg handle 75. In some aspects leg handle 75 may be used to lock the upper leg brace 48 and/or lower leg brace 43 in place on the spring retention cylinder 38 to increase the stability of the drumming throne 100. The leg handle may be located on a mounting cylinder 76. Upper leg brace 48 may be coupled to mounting cylinder 76. In some aspects mounting cylinder 76 may be mounted to or encircle spring retention cylinder 38. To lock upper leg brace 48 and lower leg brace 43 in place, a drummer may lower leg handle 45 which may tighten mounting cylinder 76 around spring retention cylinder 38, locking upper leg brace 48 and lower leg brace 43 in place. If a drummer wants to adjust the positioning of upper leg brace 48 and lower leg brace 43 a user may lift leg handle 75 to loosen mounting cylinder 76 around spring retention cylinder 38, allowing the drummer to lift or lower upper leg brace 48. In some aspects of the present invention, the drummer may lower leg handle 75 to loosen mounting cylinder 76 and lift leg handle 75 to tightening mounting cylinder 76. In alternative aspects of the present invention, leg handle 75 may include a turn dial, a crank or any other feature that my loosen and tightening mounting cylinder 76.

Figure 9:
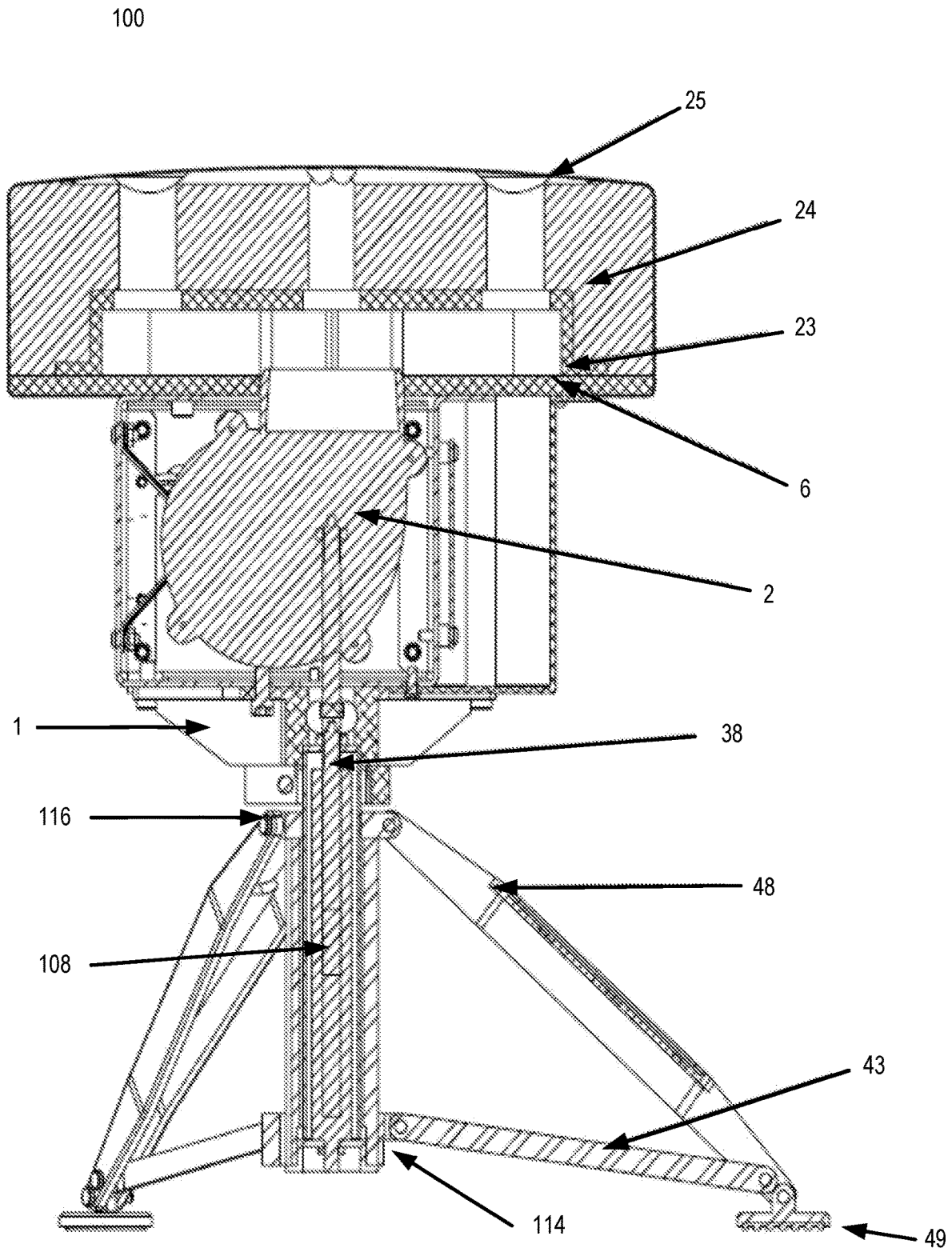
FIG. 9 is a side profile view of a cooling drummer's throne in accordance with an aspect of the present invention.

FIG. 9 illustrates another aspect of drumming throne 100. Drumming throne 100 a blower 2 to move the airflow 102 through blower exhaust 112 and into air plenum 23. From here airflow 102 moves into airflow channels 104 within seat foam 24 traversing upward towards seat cover 25 and thus to the gluteus maximus/back/legs of a user/drummer. Drumming throne 100 has a lower leg brace 43 coupled to upper leg brace 48 near seat foot 44, thus creating a right triangle to provide proper weight distribution and stability for a drummer. Lower leg brace 43 couples to a lower portion of spring-retention cylinder 114 and keeps upper leg brace 48 from extending outward indefinitely. The upper leg brace 48 is coupled to the upper portion of spring-retention cylinder 116 near the spring retention cylinder 38. Seat foot 44 is shown having non-skid grip 49 on the bottom of seat foot 44 to keep drumming throne 100 in place during drumming sessions. Mounting plate 1 supports the blower 2, intake cover 26, air plenum 23, seat foam 24, seat base 6 and gas-charged lift spring 108. In some aspects of the present invention intake cover 26 may be coupled to the seat base 6 on one end and coupled to the mounting plate 1 on the opposite end. In additional aspects blower 2 may be directly coupled to seat base 6. In other aspects blower 2 may be indirectly coupled to seat base 6.

Drumming throne 100 has an adjustable seat base height activated by a gas-charged spring 108 (FIG. 2) activated by lift handle 9. A gas spring is a type of spring, unlike a typical mechanical spring relying on elastic deformation, uses compressed gas contained within an enclosed cylinder sealed by a sliding piston to pneumatically store potential energy and withstand external force applied parallel to the direction of the piston shaft. Common applications include office chairs. The drummer would sit on drumming throne 100 and then pull up on lift handle 9 to lower drumming throne 100. The drummer could also remove their weight off drumming throne 100 and lift handle 9 once again to cause drumming throne 100 to raise.

Figure 10:
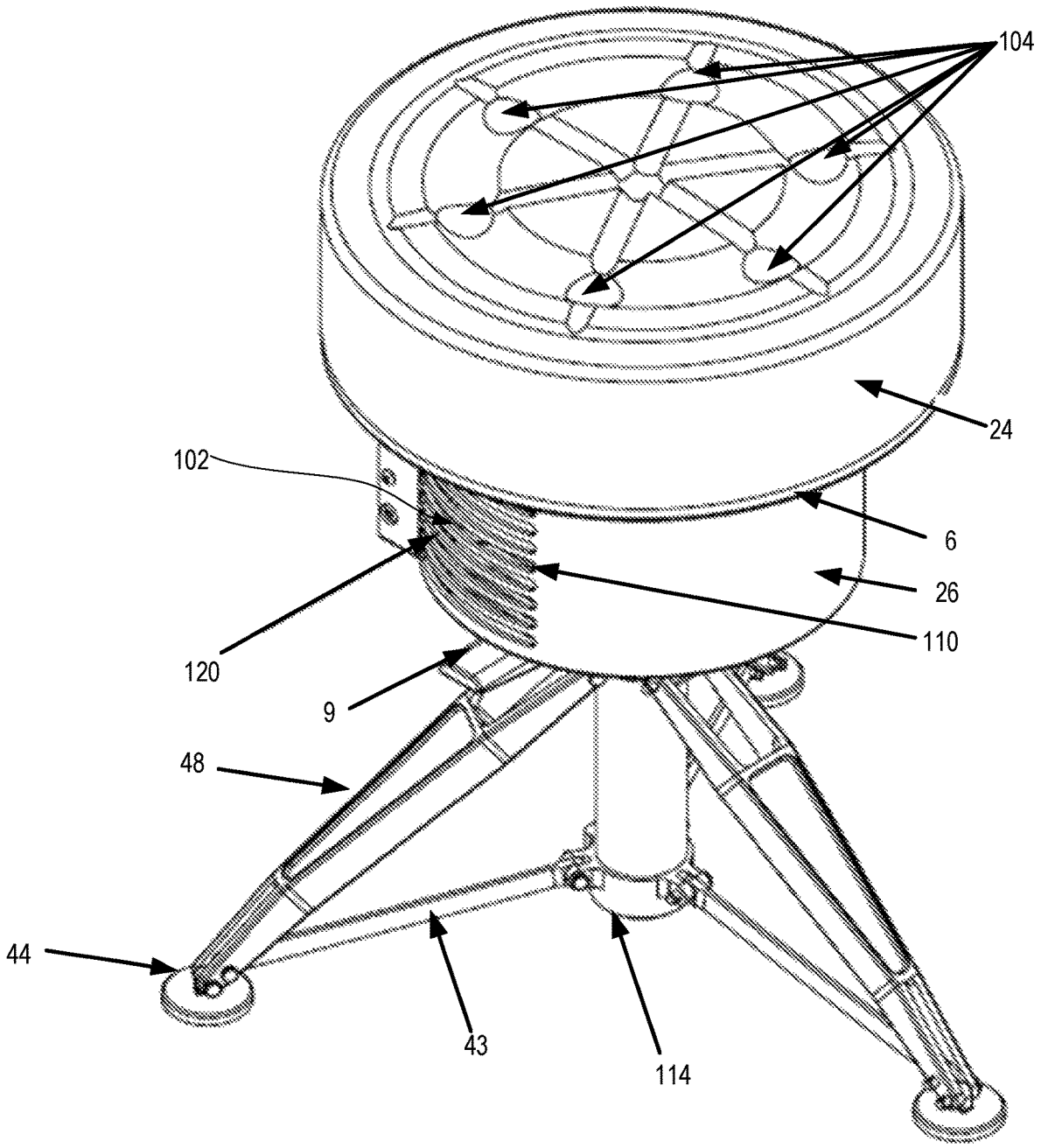
FIG. 10 illustrates another aspect of the present invention.

FIG. 10 illustrates another aspect of the present invention. Airflow 102 can be seen being brought in by blower 2 through blower intake 110. Blower 2 then moves the airflow 102 through blower exhaust 112 and into air plenum 23 (not shown). From here airflow 102 moves into airflow channels 104 within seat foam 24 traversing upward towards seat cover 25 and thus to the gluteus maximus/back/legs of a user/drummer. Seat cover 25 is coupled to seat base 6. Seat base 6 may also be coupled to intake cover 26. Drumming throne 100 has an adjustable seat base height activated by a gas-charged spring 108 (FIG. 6) activated by lift handle 9. Drumming throne 100 has a lower leg brace 43 coupled to upper leg brace 48 near seat foot 44, thus creating a right triangle to provide proper weight distribution and stability for a drummer. Lower leg brace 43 couples to a lower portion of spring-retention cylinder 114 and keeps upper leg brace 48 from extending outward indefinitely. The upper leg brace 48 is coupled to the upper portion of spring-retention cylinder 116 near the spring retention cylinder 38. Mounting plate 1 supports the blower 2, intake cover 26, air plenum 23, seat foam 24, seat base 6 and gas-charged lift spring 108. In some aspects of the present invention intake cover 26 may be coupled to the seat base 6 on one end and coupled to the mounting plate 1 on the opposite end. In additional aspects blower 2 may be directly coupled to seat base 6. In other aspects blower 2 may be indirectly coupled to seat base 6.

The invention is not to be limited to the aspects described herein. The foregoing description has been presented for purposes of illustration and description. It is not intended to be an exhaustive list or limit any of the invention to the precise forms disclosed. It is contemplated other alternatives or exemplary aspects are considered included in the invention such as the number of upper and lower leg braces, the number and direction of air flow channels, and the location of the blower, blower intake and the blower exhaust. The description is merely examples of aspects, processes or methods of the invention. It is understood any other modifications, substitutions, and/or additions can be made, which are within the intended spirit and scope of the invention.

What is claimed is:

1. A drum throne comprising:

a seat base;

a seat cover coupled on an upper portion of the seat base, wherein the seat cover further comprises a seat foam;

a mounting plate coupled below the seat base and coupled to an intake cover;

an air plenum located between the seat base and the seat foam;

a plurality of airflow channels extending from the air plenum to a top portion of the seat cover;

a blower exhaust coupled to the seat base configured for pushing air through the seat base and into the air plenum and up through the airflow channels and seat cover;

a blower located below the blower exhaust and the seat base configured for pushing air through the blower exhaust; and a blower intake coupled to the intake cover and capable of bringing air into the blower.

2. The drum throne according to claim 1, further comprising an input jack located on the intake cover and electrically coupled to the blower.

3. The drum throne according to claim 2, further comprising a power switch operatively coupled to the blower and located on the intake cover.

4. The drum throne according to claim 3, further comprising a lift handle coupled to the mounting plate for raising and lowering the seat base.

5. The drum throne according to claim 1, further comprising a spring retention cylinder coupled to the mounting plate and an upper leg brace and a lower leg brace.

6. A drum throne, comprising:

a mounting plate coupled to an intake cover;

a spring retention cylinder coupled to the mounting plate;

at least three lower leg braces coupled to a lower portion of the spring retention cylinder;

at least three upper leg braces, wherein each upper leg brace is coupled to an upper portion of the spring retention cylinder, at least one of the lower leg braces and a seat foot;

a lift handle coupled to the mounting plate;

a mounting bracket coupled to the mounting plate and the spring retention cylinder;

a blower coupled to the mounting plate;

a seat base coupled to the mounting plate;

an air plenum coupled to the seat base; and a seat foam covering the air plenum having airflow channels extending from the air plenum to a seat cover;

wherein the blower brings in air through a blower intake of the blower, the blower intake coupled to the intake cover;

wherein the blower pushes air out through an exhaust operably coupled to the air plenum.

7. The drum throne of claim 6, further comprising a dial operatively connected to the blower for adjusting speed of the blower.

8. The drum throne of claim 6, further comprising a power switch operatively connected to the blower.

9. The drum throne of claim 8, wherein the air exhausted through the air plenum travels through the air channels and through the air cover to a user.

10. A drum throne comprising:

a seat base:

a seat foam on an upper portion of the seat base;

a top portion of a seat cover for covering the seat foam;

an air plenum located between the seat base and the seat foam;

airflow channels extending from the air plenum to the top portion of the seat cover;

a mounting plate below the seat base and coupled to an intake cover;

a blower coupled to the intake cover and below a bottom portion of the seat base, the blower capable of pushing air into the air plenum, up through the airflow channels and seat cover to a user;

a blower exhaust coupled to the seat base; and a blower intake coupled to the intake cover and capable of bringing air into the blower.

11. The drum throne according to claim 10, wherein the mounting plate has at least one opening allowing air to flow to the blower intake.

12. The drum throne according to claim 11, further comprising a power switch electrically coupled to the blower and located on the intake cover.

13. The drum throne according to claim 12, further comprising an input jack located on the intake cover and electrically coupled to the blower.

14. The drum throne according to claim 13, wherein the blower pushes air out through an exhaust operably coupled to the air plenum.

* * * * *